United States Patent [19]

Campbell

[11] 4,177,650

[45] Dec. 11, 1979

[54] CRYOGENIC COOLING APPARATUS

[75] Inventor: David N. Campbell, Alcester, England

[73] Assignee: The Hymatic Engineering Company Limited, Worcestershire, England

[21] Appl. No.: 869,230

[22] Filed: Jan. 13, 1978

[30] Foreign Application Priority Data

Jan. 13, 1977 [GB] United Kingdom ..... 1336/77

[51] Int. Cl.[2] ..... F25B 41/04

[52] U.S. Cl. ..... 62/222; 62/514 JT

[58] Field of Search ..... 62/514 JT, 222, 223

[56] References Cited

U.S. PATENT DOCUMENTS

| | | | |
|---|---|---|---|
| 3,320,755 | 5/1967 | Jepsen et al. | 62/514 JT |
| 3,457,730 | 7/1969 | Berry et al. | 62/514 JT |
| 3,728,868 | 4/1973 | Longsworth | 62/514 JT |
| 4,002,039 | 1/1977 | Cramer et al. | 62/514 JT |
| 4,028,907 | 6/1977 | Herrington et al. | 62/514 JT |

FOREIGN PATENT DOCUMENTS

| | | | |
|---|---|---|---|
| 515003 | 8/1976 | U.S.S.R. | 62/514 JT |

*Primary Examiner*—Ronald C. Capossela

*Attorney, Agent, or Firm*—Oblon, Fisher, Spivak, McClelland & Maier

[57] ABSTRACT

Cryogenic cooling apparatus of the type including a generally tubular heat exchanger having a warm end and a cold end and affording two paths through one of which refrigerant gas flows from a supply under pressure to an expansion nozzle for producing cooling by means of the Joule Thomson effect in a liquefying chamber whence the low pressure gas returns through the other path to cool the incoming refrigerant, and a valve member cooperating with the nozzle to vary its effective area for automatically controlling the flow of refrigerant is characterized in that the valve is actuated by the expansion of an expander caused by the temperature of the expander itself, the expander being of elongate form and having an anchored end supported by the cold end of the heat exchanger but thermally insulated from it by a path of low thermal conductivity and extending away from the warm end of the heat exchanger to a free end which actuates the valve the expander having a warm end portion of high thermal conductivity extending from its anchored end to a region between the nozzle and the heat exchanger, which region is not in the direct line of spray from the nozzle, and a cold end portion of lower thermal conductivity extending from the said region to the vicinity of the valve.

7 Claims, 1 Drawing Figure

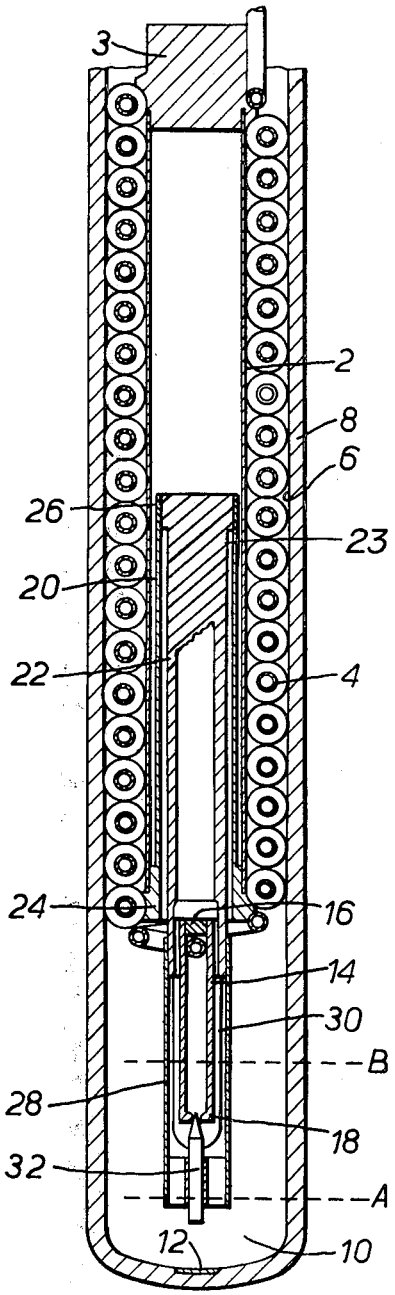
3
2
8
6
26
23
20
22
4
24
16
14
30
B
28
18
32
A
12
10

CRYOGENIC COOLING APPARATUS

This invention relates to cryogenic cooling apparatus of the type including a generally tubular heat exchanger having a warm end and a cold end and affording two paths through one of which refrigerant gas flows from a supply under pressure to an expansion nozzle for producing cooling by means of the Joule Thomson effect in a liquefying chamber whence the low pressure gas returns through the other path to cool the incoming refrigerant, and a valve member cooperating with the nozzle to vary its effective area for automatically controlling the flow of refrigerant.

An object of the present invention is to provide a form of such cooler which while simple and compact in construction, will provide a desirably smooth yet sensitive response to the amount of refrigerant liquid in the liquefying chamber and hence to what one may term the store of cooling. The liquid may be in the form of a pool of which the depth varies, or a mist or spray in which the proportion of liquid droplets varies.

The applicants have realised that the temperature of the high-pressure gas approaching the expansion nozzle differs considerably from that of the liquid refrigerant. For example in the case of air the boiling point at atmospheric pressure is about 78 K whereas that of the gas approaching the nozzle may be some 50° C. to 70° C. warmer. Moreover neither of these temperatures varies greatly with the amount of liquid present. The temperature of the liquid in equilibrium with vapour cannot vary appreciably and that of the gas approaching the nozzle is hardly affected by the amount of liquid present (once any liquid has started to condense) provided that considerable flooding of the lower part of the heat exchanger does not occur. If the lower part of the heat exchanger is flooded with liquid, the efficiency of the heat exchanger and of the liquefaction process is reduced.

While the expansion nozzle hardly comes into contact with the liquid, so that its temperature closely approximates that of the high pressure gas at the cold end of the heat exchanger, the valve member will generally be impinged upon by droplets of liquid refrigerant and will therefore be at the substantially lower temperature.

Thus the valve and the cold end of the heat exchanger may be regarded as regions of substantially constant temperature whose temperatures differ considerably, but are both but little affected by the amount of liquid present. Known coolers of the type specified generally sense a temperature which is largely anchored to one or other of these parts and therefore not sensitive to the amount of liquid present.

The present invention recognises that the temperature of a temperature-sensing element should depend on a balance between the heat flowing into it from the heat exchanger, and the heat flowing out of it to the refrigerant, and the fact that the rate of heat transfer from it to vapour is negligible compared with that to liquid.

Moreover, for simplicity and compactness of construction the invention relies on operating the valve by an expander element (having a high expansion with temperature) which forms its own temperature sensor, that is to say the expansion is due to the temperature of the expander itself the geography being so chosen that this temperature varies in the desired manner with the amount of liquid present. In some known constructions the movement of the valve is brought about by a bellows the pressure in or about which is determined, not by the temperature of the bellows itself, but by that of a remote sensor in the form of a bulb containing vapour in equilibrium with liquid. It is not easy to accomodate such a construction in a cooler of the very small size often required.

Thus according to the present invention the valve is actuated by the expansion of an expander caused by the temperature of the expander itself, the expander being of elongate form and having an anchored end supported by the cold end of the heat exchanger but thermally insulated from it by a path of low thermal conductivity and extending away from the warm end of the heat exchanger to a free end which actuates the valve, the expander having a warm end portion of high thermal conductivity extending from its anchored end to a region between the nozzle and the heat exchanger which region is not in the direct line of spray from the nozzle, and a cold end portion of lower thermal conductivity extending from the said region to the vicinity of the valve.

In a preferred construction the anchored end of the expander is mounted on one end of a re-entrant expander carrier having its other end carried by the cold end of the heat exchanger whence it extends towards the warm end of the heat exchanger, the carrier being of low thermal conductivity and of low coefficient of thermal expansion.

Thus in one form of the present invention a cryogenic cooling apparatus comprises a generally tubular heat exchanger having a warm end and a cold end, a seating carrier secured to the cold end of the heat exchanger and extending away from its warm end to a cold end which carries a seating, an expander carrier having one end fixed to the heat exchanger adjacent its cold end and extending thence towards the warm end of the heat exchanger to a second end, an expander of elongated form having a warm end secured to the second end of the expander carrier, and extending thence past the cold end of the heat exchanger to a cold end adjacent the seating, a valve member carried by the cold end of the expander and cooperating with the seating so as to tend to close the nozzle as the expander contracts, and means for passing gaseous refrigerant at high pressure through one path of the heat exchanger from its warm end, thence through the seating acting as Joule Thomson expansion nozzle and back through the other path of the heat exchanger to cool incoming refrigerant, the expander being of substantially higher coefficient of expansion than the expander carrier and being formed in two portions, a warm end portion and a cold end portion whereof the warm end portion is of substantially higher thermal conductivity than the expander carrier and the cold end portion so that the temperature difference along the length of the expander is predominantly in its cold end portion.

Preferably the expander carrier is of generally tubular or part tubular form surrounding the warm end portion of the expander and shielding it from heat from the heat exchanger. The expander may also be of generally tubular form with its cold end exposed to impingement by refrigerant ejected from the nozzle.

References herein to a cold end and a warm end are intended to be interpreted purely comparatively and it will be appreciated that the warm end of one member may be cooler than the cold end of another member.

The warm portion of the expander may extend beyond the cold end of the heat exchanger into the liquefying chamber so as to be brought into contact with the liquid refrigerant, or with a high proportion of liquid droplets as opposed to gas, when the quantity of liquid in the liquefying chamber reaches a value at which the supply of refrigerant can be cut off.

The expander my take various forms. It may include a bellows filled with gas and/or liquid, the expansion of which varies with the temperature of the bellows. Alternatively it may include a stack of curved bimetallic discs stacked with their curvatures in alternate directions, the curvature varying with temperature. Again it may include a grid of bars or a set of coaxial tubes of alternate high and low coefficient of expansion each connected at one end to one neighbour and at the other end to another so that their differential expansions are additive.

For convenience and simplicity, however, the expander may comprise a simple bar or tube of high coefficient of thermal expansion relatively to other parts of the apparatus.

Further features and details of the invention will be apparent from the following description of one specific embodiment that will be given by way of example with reference to the accompanying drawing which is a sectional elevation of cooling apparatus in accordance with the invention.

In the embodiment to be described the cooling apparatus, like most of those of the specifications referred to above, is of elongate form and although it may operate in various orientations it will be described in the position in which it would normally be used with its axis vertical and its cold end at the bottom.

The apparatus includes a tubular heat exchanger comprising an inner tubular body 2 which is sealed by a bung 3 and around which is helically wound a finned inlet tube 4 forming the inlet path of the heat exchanger. An external co-axial tube formed by the inner wall 6 of a Dewar flask 8 is located round the finned coil, and the space between the inner body 2 and the external tube 8 provides the second or exhaust path of the heat exchanger for exhaust gas flowing past the fins to cool the incoming high pressure refrigerant within the helically coiled tube forming the inlet path. The lower end of the Dewar flask 8 is closed to provide within it a liquefying chamber affording a reservoir 10 in which the liquid working fluid can accumulate. A load 12 to be cooled such as an infra-red radiation detector, is formed on or secured to the outer face of the inner wall of the Dewar flask.

The body 2 of the heat exchanger is of a material of low heat conductivity. At its lower cold end the body of the heat exchanger carries a T-shaped seating carrier 14, the head 16 of the T extending across and being secured to the lower, cold, end of the heat exchanger body. The stem of the T is hollow and at its lower end it affords a downwardly opening seating 18 to provide an expansion nozzle.

Also, secured inside the lower end of the heat exchanger body 2 is the lower end of a tubular expander carrier 20 which extends upwards a substantial distance coaxially within the heat exchanger and surrounds, and at its upper end carries, the upper end 22 of a tubular expander. The expander may also be a simple bar as shown at 23. The expander carrier has an external flange 24 at its lower end and an internal flange 26 at its upper end so that the body 2 of the heat exchanger, the expander carrier 20, and the upper part 22 of the expander, form three coaxial tubes one inside the other with spaces between them, but connected together at the flanges 24 and 26.

The expander is in two portions, the upper warm portion 22 which extends from the top of the carrier 20 down to and slightly below the bottom or cold end of the heat exchanger so as to project a short distance into the top of the liquefying chamber. It is secured to a lower cold portion 28 which extends down beyond the seating 18 and at its lower end carries a valve needle 32 projecting upwards and having a conical end cooperating with the seating 18. The needle 32 may be screwthreaded in the expander so as to be adjustable. The lower portion 28 of the expander has in it a pair of large longitudinal slots 30 through which the seating carrier 14 is accessible so that its head 16 may extend laterally to be secured to the lower end of the heat exchanger body.

An important aspect of the construction described is the choice of materials of different thermal conductivity and expansion coefficient. Both portions 22 and 28 of the expander are of high coefficient of expansion but whereas the upper warm portion is of high conductivity the lower cold portion is of low conductivity. It will be appreciated that due to the different coefficients of expansion and temperatures of the expander, the body of the heat exchanger, and the seating carrier, and the expander carrier, the valve will be moved towards its closed position, in known manner, as the average temperature of the expander falls.

To accommodate an expander of sufficient length to obtain adequate valve movement in a compact cooler is it desirable that the expander should extend up into the heat exchanger but to obtain the advantage of this the whole length of the expander should be of high coefficient of expansion while the expander carrier should be of low coefficient of expansion since its expansion tends to nullify that of the expander, and close the valve rather than opening it.

As regards conductivity the invention aims at securing operation primarily in response to the temperature of the expander at a point adjacent to the top of the liquefying chamber near the cold end of the heat exchanger. Thus if there is excessive response to the temperature of the heat exchanger the control tends to be insensitive, while if there is excessive response to the spray of liquid close to the nozzle the valve will start to close as soon as liquid begins to be produced, and cooling to produce a store of liquid refrigerant will be unduly slow.

The following table gives materials of various components of a specific embodiment, together with properties of each material and of the complete component where this is important.

TABLE

| PROPERTIES OF MATERIALS | | | TOTAL PROPERTIES OF COMPONENT | | |
|---|---|---|---|---|---|
| Component | Material | Expansion Thermal Cooefficient °K.$^{-1}$ | Thermal Conductivity watts/Cm°K. | Thermal Resistance °K./watt | Thermal Expansion $\mu$ in/°K. |
| Body of heat exchanger | Austenitic Stainless Steel | $18 \times 10^{-6}$ | .13 | 2820 | — |
| Expander carrier | Invar | $2 \times 10^{-6}$ | .1 | 1430 | 4.3 |
| Expander warm end | Copper | $19 \times 10^{-6}$ | 2.0 | 164 | 21.6 |
| Expander, cold end | Monel | $18 \times 10^{-6}$ | .15 | 1470 | 6.4 |
| Valve Needle | Austenitic Stainless Steel | $18 \times 10^{-6}$ | .13 | — | 1.8 |
| Seating carrier | Composite, Steel & Brass | $18 \times 10^{-6}$ | .2 - .8 | — | 7.6 |

The thermal properties and dimensions of the various parts are chosen with these considerations in mind.

Thus the upper end 22 of the expander is not secured to the adjacent warm part of the body 2 of the heat exchanger, but is connected to the lower cold end of the latter through the expander carrier 20 which not only shields it from radiant heat but is itself of material of low conductivity. Hence the conduction of heat from the heat exchanger to the expander is reduced to an appropriate extent to secure sensitivity, without rendering the valve unduly slow in responding when more cooling is required.

To ensure rapid cooling when required, when liquid refrigerant has just begun to be formed, the high cooling rate of the liquid spray is confined to the region in the neighbourhood of the needle valve, that is to say the lower end of the cold portion 28 of the expander. Due to the low conductivity of this portion of the expander the whole of the upper warm portion 22 of the expander remains relatively warm so that the valve remains substantially open and cooling takes place at a substantial rate.

As the cooling effect of the liquid increases, either in the form of a pool of which the level rises, or in the form of droplets of which the proportion in the gas increases, the temperature of the warm end of the lower portion 28 of the expander will be progressively reduced. This reduced temperature will be applied to the lower end of the upper warm portion 22 of the expander and since this is of high thermal conductivity, the reduced temperature will affect its whole length thereby progressively closing the valve.

In practice the level of liquid refrigerant will vary between a low and high level shown in the drawing as A and B. The temperature of the components of the cooling apparatus will vary according to the level of the liquid refrigerant. In a specific embodiment the temperature of certain of the components at the high and low levels of refrigerant were as follows:

| Component | Temperature °K. Low level A | High Level B |
|---|---|---|
| Bung sealing heat exchanger | 290 | 290 |
| Internal flange at top of expander carrier | 156 | 115 |
| External flange at bottom of expander carrier | 153 | 152 |
| Upper part of lower portion of expander | 152 | 101 |

-continued

| Component | Temperature °K. Low level A | High Level B |
|---|---|---|
| Valve seating | 153 | 152 |
| Lower part of lower portion of expander. | 80 | 77 |

In designing the components of the apparatus it is important to ensure that the upper part 22 of the expander is as far as practicable shielded from the spray of liquid from the nozzle. The lower end of the cold part 28 of the expander should come into significant contact with liquid or liquid droplets after the load has achieved the desired temperature either by contact or heat exchange relationship with significant quantity of liquid or liquid droplets. The thermal conductivity and the thermal coefficient of expansion and thermal capacities of the two portions 22 and 28 of the expander and of the expander carrier 20 should be chosen (a) to maintain the needle valve close to its fully open position during the cool down period, (b) to cause the temperature of the expander to change rapidly as the wetted area of the lower cold end extends towards the junction with the upper warm end so as to give sensitive control and (c) to provide optimised conductivity from the upper warm end of the expander to the heat exchanger in order to minimise excessive conduction which would render the control insensitive whilst providing sufficient conductivity to allow the expander to warm up and actuate the valve with an adequate time reponse when the level of liquid or proportion of droplets falls below the desired value.

What we claim as our invention and desire to secure by Letters Patent is:

1. Cryogenic cooling apparatus of the type including a generally tubular heat exchanger having a warm end and a cold end and affording two paths, through one of which refrigerant gas flows from a supply under pressure to an expansion nozzle for producing cooling by means of the Joule Thomson effect in a liquefying chamber in said apparatus while the low pressure gas returns through said other path to cool the incoming refrigerant, said cryogenic cooling apparatus including a valve member cooperating with said nozzle to vary the effective area of said nozzle for automatically controlling the flow of said refrigerant, said valve being connected to an expander wherein said valve is actuated by the expansion of said expander, said expansion being caused by the temperature of said expander, said expander being of elongate form and having an anchored end, said anchored end supported by said cold end of said heat exchanger but thermally insulated from said cold end of said heat exchanger by a path of low thermal conductivity, said expander extending away from said warm end of said heat exchanger to terminate in a free end which actuates said valve, said expander having a warm end portion of high thermal conductivity extending from its anchored end to a region between said nozzle and said heat exchanger, said region being out of the direct line of spray of refrigerant from said nozzle, said expander also having a cold end portion of lower thermal conductivity extending from said region to the vicinity of said valve.

2. Apparatus as claimed in claim 1 in which said anchored end of said expander is mounted on one end of a re-entrant expander carrier having its other end carried by said cold end of said heat exchanger from which it extends towards said warm end of said heat exchanber, said carrier being of low thermal conductivity and of low coefficient of thermal expansion.

3. Cooling apparatus comprising a generally tubular heat exchanger having two paths and a warm end and a cold end, a seating carrier secured to said cold end of said heat exchanger and extending away from said warm end to said cold end which carries a seating, an expander carrier having one end fixed to said heat exchanger adjacent said cold end and extending thence towards said warm end of said heat exchanger to terminate in a second end, an elongated expander having a warm end secured to said second end of said expander carrier, and extending thence past said cold end of said exchanger to form said expander cold end adjacent said seating, a valve member carried by said cold end of said expander and cooperating with said seating so as to tend to close said seating as said expander contracts, and means for passing gaseous refrigerant at high pressure through one path of said heat exchanger from said warm end, thence through said seating which acts a Joule Thomson expansion nozzle and back through said other path of said heat exchanger to cool incoming refrigerant, said expander being of substantially higher coefficient of expansion than said expander carrier and being formed in two portions, a warm end portion and a cold end portion whereof said warm end portion is of substantially higher thermal conductivity than said expander carrier and said cold end portion so that the temperature difference along the length of said expander is predominantly in said cold end portion.

4. Apparatus as claimed in claim 3 in which said expander carrier is of generally tubular or part tubular form surrounding said warm end portion of said expander and shielding it from heat from said exchanger.

5. Apparatus as claimed in claim 3 in which said expander is of generally tubular form with its cold end exposed to impingement by refrigerant ejected from said nozzle.

6. Apparatus as claimed in claim 3 in which said warm portion of said expander extends beyond said cold end of said heat exchanger into said liquefying chamber.

7. Apparatus as claimed in claim 3 in which said expander comprises a simple bar of high coefficient of expansion relatively to other parts of said apparatus.

* * * * *